US005262241A

United States Patent [19]

Huggins

[11] Patent Number: 5,262,241

[45] Date of Patent: Nov. 16, 1993

[54] SURFACE COATED PRODUCTS

[75] Inventor: Gary E. Huggins, Fairfax, Calif.

[73] Assignee: Eeonyx Corporation, Emeryville, Calif.

[21] Appl. No.: 839,800

[22] Filed: Feb. 21, 1992

Related U.S. Application Data

[63] Continuation-in-part of Ser. No. 750,894, Aug. 26, 1991.

[51] Int. Cl.[5] ..... B32B 27/06; B32B 15/08

[52] U.S. Cl. ..... 428/421; 428/422; 428/457; 428/463; 428/492

[58] Field of Search ..... 428/209, 457, 463, 492, 428/421, 422

[56] References Cited

U.S. PATENT DOCUMENTS

| | | | |
|---|---|---|---|
| 3,574,658 | 4/1971 | Fulk et al. | 428/209 |
| 3,754,976 | 8/1973 | Babecki et al. | 427/205 X |
| 4,215,178 | 7/1980 | Martin, Jr. | 428/421 |
| 4,228,670 | 10/1980 | Corti et al. | 72/42 |
| 4,312,900 | 1/1982 | Simpson | 427/181 |
| 4,333,840 | 6/1982 | Reick | 252/16 |
| 4,349,444 | 9/1982 | Reick | 252/16 |
| 4,415,419 | 11/1983 | Neederhaeuser et al. | 204/192.15 |
| 4,552,784 | 11/1985 | Chu et al. | 427/192 |
| 4,553,417 | 11/1985 | Badger | 72/42 |
| 4,753,094 | 6/1988 | Spears | 427/11 X |

OTHER PUBLICATIONS

E/M Corporation, Microseal Processes, (1989) (Sales Brochure).

Reick, F. G., "Energy-Saving Lubricants Containing Colloidal PTFE", J of the Amer. Soc. of Lub. Eng., vol. 38, 10, pp. 635-646 (1981).

Milton, B. E. et al., "Fuel Consumption and Emission Testing of an Engine Oil Additive Containing PTFE Colloids", J of the Amer. Soc. of Lub. Eng., vol. 39,2, pp. 105-110 (1983).

Guttman, M. et al., "The Influence of Oil Additives on Engine Friction and Fuel Consumption", Am. Soc. Lub. Eng. preprint No. 84-AM-7D-1 (1984).

Reick, F. G., "Variability of PTFE Colloids in Nonaqueous Systems and Lubricating Oils", J of the Amer. Soc. of Lub. Eng., vol. 44,8, pp. 660-664 (1988).

Bauccio, M. L., "Research and Development with Polytetrafluoroethylene in Automotive Lubricants", a U.S. Army Aviation Systems Command Publication, (undated, apparently published circa 1984-85).

*Primary Examiner*—Thomas J. Herbert, Jr.

*Attorney, Agent, or Firm*—Albert C. Smith; David L. Hayes; Leo V. Novakoski

[57] ABSTRACT

Thin impermeable, corrosion-resistant, durable, dry lubricant coatings are provided as well as coated products and methods for the production thereof. The coatings comprise solutions of sulfur-containing metallic compounds and fluorocarbon polymers dissolved in mineral oil solvents and are applied to surfaces of substrates such as metallic surfaces.

14 Claims, 1 Drawing Sheet

SURFACE COATED PRODUCTS

RELATED APPLICATION

This application is a continuation-in-part of co-pending application Ser. No. 750,894, filed Aug. 26, 1991, entitled "Surface Finishes and Methods for the Production Thereof", the disclosure of which is incorporated herein by reference.

BACKGROUND OF THE INVENTION

This invention relates to surface coatings which impart nonabradable and nonetchable, durable dry lubricity, corrosion resistance and improved permeability characteristics to a substrate and to methods for applying such coatings to a substrate.

Although this invention is primarily directed to the coating of metallic substrates, it is likewise applicable to coatings for application to other suitable substrate materials such as ceramic, graphite and rubber compositions and various mineral surfaces. Furthermore, the metallic substrates employed herein may range from very hard metals having a hardness factor measured on the Rockwell C scale of greater than 40 to soft metals having hardness values measured on the Rockwell B scale.

A wide variety of corrosion-resistant coatings and liquid lubricant compositions and methods for the application of such coatings and lubricants to substrates have been disclosed heretofore. Examples thereof may be found in U.S. Pat. Nos. 3,574,658; 3,754,976; 4,228,670; 4,312,900; 4,333,840; 4,349,444; 4,415,419; 4,552,784; 4,553,417 and 4,753,094. Also, various automotive motor oil lubricant compositions have been disclosed heretofore in publications such as Reick, F. G., "Energy—Saving Lubricants Containing Colloidal PTFE", Journal of the American Society of Lubrication Engineers, Vol. 38, 10, pp. 635–646 (1981); Milton, B. E. et al., "Fuel Consumption and Emission Testing of an Engine Oil Additive Containing PTFE Colloids", Journal of the American Society of Lubrication Engineers, Vol. 39, 2, pp. 105–110 (1983); Guttman, M. and Stotter, A., "The Influence of Oil Additives on Engine Friction and Fuel Consumption", American Society of Lubrication Engineers Preprint No. 84-AM-7D-1 (1984); Reick, F. G., "Variability of PTFE Colloids in Nonaqueous Systems and Lubricating Oils", Journal of the American Society of Lubrication Engineers, Vol. 44, 8, pp. 660–664 (1988); and Bauccio, M. L., "Research and Development with Polytetrafluoroethylene in Automotive Lubricants", a U.S. Army Aviation Systems Command publication, based on a paper presented at the 5th International Colloquium on Additives for Lubricants and Operational Fluids, at the Technische Akademie Esslingen, Esslingen, Germany, on Jan. 14–16, 1986.

Several of the above-noted patents disclose processes for applying coatings to the surface of work pieces by a peening or blasting procedure in which the coating material is applied to the surface by pellets or other shot material impacted at high pressure against the surface of the work piece in order to apply the coating on the pellets or shot to the surface of the work piece.

Other of the above-noted patents and publications disclose fluid compositions for application to substrate surfaces in order to provide lubricant films or coatings on such surfaces. For example, U.S. Pat. No. 4,333,840 discloses a lubricant composition of PTFE in a motor oil carrier diluted with a major amount of a synthetic lubricant having a low viscosity and a high viscosity index. Optionally, a small amount of an oil-soluble molybdenum compound (i.e., about 1%) is included in the composition but, when the percentage of molybdenum compound is excessive relative to the lubricant composition (i.e., in excess of about 1%), the resultant film formed on a metal substrate will be unduly thick and will not provide the described lubricant coating. Also, in U.S. Pat. No. 4,349,444, another hybrid fluid lubricant composition is disclosed in which PTFE particles are uniformly dispersed by a fluorochemical surfactant and are diluted with a major amount of a conventional oil lubricant. The hybrid lubricant includes a small amount (i.e., about 1%) of an oil-soluble organic molybdenum compound. Again, the percentage of molybdenum compound must be small (i.e., about 1%) in order to achieve the results described therein. U.S. Pat. No. 4,415,419 discloses a process for applying a corrosion resistant coating on a sulfide-forming metal substrate such as a sulfided molybdenum surface by cathodic sputtering of a composite lubricant coating of molybdenum disulfide and PTFE onto the sulfided metal layer.

However, none of the prior disclosures have provided products demonstrating the combination of characteristics and properties which are achieved by the coatings and coated products of the present invention, nor do the prior disclosures provide the necessary processes for producing such coated products. Indeed, the need to prolong the wear-life of substrate surfaces such as metal surfaces and to reduce the frictional properties thereof in order to reduce repair and replacement costs has been and continues to be the focus of intensive research and development efforts. Nonetheless, these efforts have achieved only relatively limited success resulting from the use of previously known coatings, paints and lubricants (both wet and dry). Each of the known techniques for treating substrates such as metal surfaces has presented significant problems and drawbacks in regard to the cost, difficulties in application, product properties achieved and the like.

With regard to prior processes for imparting desirable physical properties of polymers to substrate surfaces such as metal surfaces, it has been common to employ fluorocarbon polymers such as tetrafluoroethylene (TFE) sold, for example, under the tradename "Teflon" by E. I. Du Pont de Nemours & Co. (Inc.), as a coating material. Teflon-coated surfaces are known to reduce friction and adhesion, but the Teflon must be applied to the substrate by use of primers such as epoxy and requires high temperatures for application. The coated surface, accordingly, abrades under modest pressure and does not coat evenly or thinly.

SUMMARY OF THE INVENTION

The present invention overcomes many of the known shortcomings of the prior art. The invention comprises preparing a coating solution containing mineral oil, a sulfur-containing metallic compound such as molybdenum disulfide or tungsten disulfide and a fluorocarbon polymer such as tetrafluoroethylene, and dipping or immersing a substrate into this coating solution at a sufficient temperature and for a sufficient period of time to allow a uniform coating of the surface of the substrate to be achieved. Preferably, the coating solution includes a ratio of between about 1:1 and about 10:1 parts fluorocarbon polymer to sulfur containing metallic compound (on a weight percentage basis) with a sufficient amount (by volume) of mineral oil being present to dissolve the solid fluorocarbon polymer and sulfur-containing metallic compound constituents of the coatings.

As a result of the application of such coatings to the surface of a treated substrate, it has been found that the resulting product demonstrates outstanding corrosion resistance as well as long-lasting, durable dry lubricity characteristics. Furthermore, the coatings have been found to provide a relatively thin, impermeable exterior on the surface of the substrate or work piece. For example the thickness of the present coatings preferably may range from about 0.5 microns to about 3 microns. In most instances, these coatings have been found to be sufficiently thin so that the coatings do not interfere with critical tolerances of any processed parts or components.

Accordingly, it is a general object of the present invention to provide new and improved coatings for application to substrates and to provide methods of applying such coatings to substrates, especially to small-sized substrate surfaces such as those presented by ball bearings, microassemblies, small diameter geometric and tubular goods and other like small objects.

Another object is to provide corrosion-resistant surface coatings demonstrating long-lasting, durable dry lubricity characteristics as well as providing an impermeable outer surface on a substrate.

A further object is to provide methods for producing corrosion-resistant, long-lasting, durable dry lubricant coatings on substrates.

A further object is to provide a surface coated product having a high degree of permanent dry lubricity.

Another object is to provide a coated metal surface exhibiting long-lasting, durable dry lubricity and high resistance to temperature extremes.

A still further object is to provide methods for producing thin coatings which exhibit long-lasting, durable dry lubricity, corrosion and heat resistance as well as improved permeability properties.

Yet another object is to provide methods for relatively easy and inexpensive application of the coatings of this invention to substrate surfaces.

Other objects of this invention, in addition to those set forth above, will become apparent to one of ordinary skill in the art from the following description.

DETAILED DESCRIPTION

Figure 1:
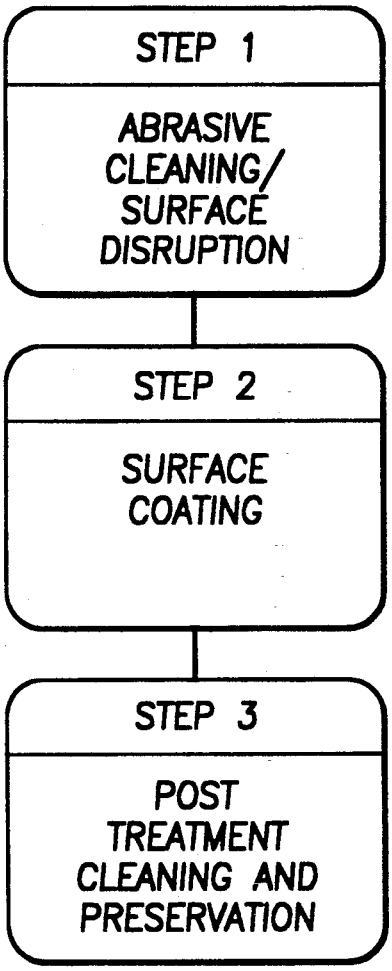
FIG. 1 is a schematic flow diagram of one preferred method of application of the coatings of the present invention.

FIG. 1 of the drawings is a schematic flow diagram showing an embodiment of the methods of the present invention for applying coatings to a substrate.

In the preferred embodiment of the methods of the present invention for applying coatings to a substrate illustrated in FIG. 1, a multistep process is employed wherein a substrate surface is first subjected to an optional abrasive cleaning/surface disruption step in order to cleanse the surface of the substrate sufficiently to promote adhesion of the subsequently applied coating composition onto the surface of the substrate by substantially removing loose surface contamination and oxidized materials or other like residues from the surface. In addition, this abrasive cleaning/surface disruption step provides a sufficient and appropriate amount of disrupted surface area on the surface of the substrate which likewise promotes the adhesion of the coating onto the surface of the substrate.

The abrasive cleaning/surface disruption step may be performed in a blast cabinet environment in accordance with the procedures disclosed for precleaning in U.S. Pat. No. 4,753,094 (the disclosure of which is incorporated herein by reference). The specific parameters of treatment within this step of the process are subject to choice, depending on the substrate material and its intended end use. For example, the delivery pressure/velocity, temperature, angle of delivery, duration of blasting and like parameters of the process will vary depending on whether final treatment of the substrate is intended to increase dry lubricity, wear resistance, quick release (i.e., non-sticking effect), operative temperature range and/or corrosion resistance.

In regard to the blast materials to be used for this abrasive cleaning/surface disruption step, it has been found that for softer, nonferrous metals and alloys (e.g., aluminum, copper, lead, magnesium, zinc, beryllium, gold, tin, bronze, brass, etc.), glass beads, nylon or plastic particles or aluminum shot may be employed for blast cleaning the surface of the substrate. For harder, nonferrous metals (e.g., nickel) and for ferrous metals and alloys (e.g., iron; molybdenum, chromium, tungsten and vanadium steels and stainless steel), aluminum oxide particles, silicon carbide particles, glass beads, sand particles, steel shot and the like may be used to provide the cleaning/disruption action on the surface of the substrate. In this regard, it has been found that less aggressive media (e.g., glass beads) may be used for applications where a characteristic such as quick release or non-sticking is desired, while more aggressive media such as aluminum oxide or silicon carbide are preferred for use in applications where end product characteristics such as increased wear resistance or dry lubricity are desired.

In regard to the delivery pressures to be employed for performing this abrasive cleaning step, it is believed that pressures up to 250 psi may be employed for hard and very hard substrates such as chrome/molybdenum steels and tungsten carbides, whereas lower delivery pressures of as low as about 20 psi may be used in other applications. As employed herein, the term "delivery pressure" is defined as the blast pressure applied to a substrate at a distance of two inches from the nozzle of the delivery device.

The temperature range to be employed in performing this abrasive cleaning step appears to be a matter of selection and not to be determinative of the quality of the surface treatment achieved. However, it has been found that temperatures ranging between ambient temperatures and about 50° C. are suitable for this cleaning step.

In specific abrasive cleaning/surface disruption processes employed in the laboratory, substrates which were to be cleaned/disrupted with aluminum oxide (extra fine grade-Brownells) utilized a TechniBlast Model 36 Cleaning Machine, sold under the trademark "SURFGARD" at 58 cubic feet per minute at 100 pounds pressure. This cleaning machine was equipped with a 3/16-inch blast gun with a ceramic nozzle. Alternatively, substrates which were to be cleaned/disrupted with glass beads (#270 U.S. Sieve Size-Brownells) were blasted utilizing a Trinco Direct Pressure Cabinet Model 36×30/PC equipped with a ¼-inch nozzle (I.D.), and the substrate was blasted at 60–120 psi (preferably about 80–100 psi) at a distance of between about 2 inches and 12 inches (preferably about 6–8 inches) at an angle of about 20°–90° (preferably about 30°–60°) until a uniformly disrupted surface was obtained and all surface contamination was removed.

Once this preliminary abrasive cleaning/surface disruption step is completed, the substrate is then in condition to be processed in accordance with the present invention.

In accordance with the present invention, the precleaned substrate which, for example, may be in the form of an unprocessed sheet or strip of material or a preprocessed part or work piece is submerged in a preformulated coating solution in a vat or container at a sufficient temperature for a sufficient period of time to cause a thin, impermeable, corrosion-resistant, durable, dry lubricant coating to form on the surface of the substrate. Preferably, the coating solution is maintained at a temperature in the range of about 30°–40° C. (more preferably, about 35°–40° C.) with constant agitation, and the substrate to be coated is immersed in the coating solution for a period of at least about 10 minutes (more preferably, about 15 minutes) before being withdrawn from the solution.

In practice, the substrate surface to be treated is preferably a metallic surface. However, as previously noted herein, the substrate may be any suitable ferrous or nonferrous metal or alloy of a metal or a ceramic, graphite or rubber composition.

In general, the coating compositions of this invention comprise solutions of solid lubricants formulated to provide dry lubrication and/or corrosion resistance and/or non-stick properties desired for purposes of the end use of the product. The solid lubricants are dissolved in appropriate mineral oil solvents. Suitable solid lubricants for use in the coating solutions of the present invention include fluorocarbon polymers and carrier or binder polymers.

Exemplary of suitable fluorocarbon polymers are homogenates or mixtures of finely-divided fluorocarbon resins having fully fluorinated carbon backbones such as tetrafluoroethylene homopolymer (TFE), hexafluoropropylene (HFP), perfluoroalkoxyvinyl ether (PPVE), copolymers of TFE and HFP, copolymers of TFE and PPVE. Other suitable fluorocarbon polymers are fluoropolymer resins which are not fully fluorinated such as ethylenetetrafluoroethylene (ETFE), polyvinylidene fluoride (PVDF), ethylenechlorotrifluoroethylene (ECTFE), copolymers of ethylene and TFE such as products sold under the trademark "Tefzel" by E. I. Du Pont de Nemours & Co. (Inc.). The molecular weight of the fluorocarbon polymers to be used herein may vary over a relatively wide range although molecular weights of from about 800 to about 2000 are preferred and, particularly about 1000–1800. Furthermore, it should be noted that mixtures of fluorocarbon polymers of varying molecular weights may be advantageously employed herein as, for example, mixtures of tetrafluoroethylenes having molecular weights of 1100 and 1300.

In summary, the fluorocarbon polymers are chosen for their ability to impart their individual characteristics to the substrate and for their affinity to the substrate, carrier molecule, and/or the other solid lubricant material chosen. Furthermore, suitable fluorocarbon polymers for use herein are impermeable and chemically unreactive to water and various other chemical constituents, UV radiation and gases. The polymers are highly thermally stable and will withstand high upper surface temperatures (i.e., about 200° C.–260° C.) as a result of their high C—F and C—C bond strengths and the resulting non-polar nature of the linear polymer. These resins have a low coefficient of friction and a low dielectric constant and dissipation factor. They exhibit a high degree of linear flexibility and are flame resistant.

The other solid lubricant component of the coating solutions employed herein is a sulfur-containing metallic compound which acts as a carrier or binder herein. Suitable metal sulfides for purposes of the present invention possess anti-friction/dry lubrication capabilities, can withstand increased operating temperatures and/or demonstrate high affinity towards metals such as those employed as the substrates herein as well as demonstrating high affinity toward the fluorocarbon polymers selected as part of the coating compositions.

Representative of suitable sulfur containing metallic compounds for use herein are sulfides of molybdenum, tungsten, lead, tin, copper, calcium, titanium, zinc, chromium, iron, antimony, bismuth, silver, cadmium and alloys and mixtures thereof.

In a preferred form, molybdenum disulfide is employed as the sulfur-containing metal compound in the coating solutions employed. Molybdenum disulfide has a high affinity to steel and other base metals and has the ability to increase substrate hardness, corrosion resistance, elevated-temperature strength and dry lubricity. It also has a high affinity to fluorocarbon micropowders which may be employed advantageously herein. Thus, it has been found that use of molybdenum disulfide herein provides the dual function of a dry lubricant additive as well as a carrier/binder molecule for the fluorocarbon polymer thereby advantageously promoting formulation of the coating compositions herein and their application to substrates.

Suitable mineral oils for use as solvents for the solid lubricants to form the coating solutions of this invention may be chosen from a wide variety of liquid products of mineral origin having Saybolt viscosities in the range of about 55 to about 400 encompassing both heavy and light grade oils. For example, standard motor oil formulations having viscosities, for example, of from about 10 W to about 30 W may be utilized as the mineral oil solvent constituent of the coating solutions of this invention.

The use of motor oil solvents although suitable herein has been found to present certain problems in regard to heating and maintenance of temperatures of solutions. Also, problems have been encountered regarding adherence of the coatings to substrate materials treated with such solutions requiring repeated calibration of formulations and difficulty in cleaning of substrate materials emerging from the solution. These difficulties with motor oils render other mineral oils more preferred for use herein, especially those oils which may be heated rapidly and maintain their temperature over more extended periods and which do not adhere as aggressively to substrate surfaces so that removal of the constituent from the solution is not as pronounced and cleaning of the resulting coated substrate surface may be more readily accomplished. Exemplary of such preferred mineral oils are refined veterinary grade mineral oils having Saybolt viscosities ranging from 55 to 400 and, especially, oils with Saybolt viscosities of 70, 90, 200 or 350.

In general, the amount of fluorocarbon polymer to be incorporated in the coating solution to provide th requisite coated substrate is determined by the amount of such polymer required to keep the mineral oil completely permeated during the submersion step of the present process.

In a laboratory example of the practice of the present invention, a vat was employed consisting of a rectangular stainless steel tank having a 1" ethylene glycol insulation jacket with outlet valves for both the tank and the insulation jacket allowing for independent drainage thereof. The tank inside dimensions were 25" long by 11.25" wide by 9" deep and had a 10 gallon liquid capacity. The tank was equipped with two Lauda Model MS Heating Circulators mounted with screen clamps at each corner along the back side of the tank. Circulator nozzles were directed to the center of the vat. The pump capacity was 8 lpm (2.25 gpm) and heating coils were immersed in the solution which was introduced into the tank.

The tank was filled with 9 gallons of veterinary grade mineral oil to which 500 ml by volume (1.76 kg by weight) tetrafluoroethylene having a molecular weight of about 1100 (Teflon Fluoroadditive Type MP 1100, Lot # BMAB 40 D002, Du Pont) was added along with 500 ml by volume (2.83 kg by weight) tetrafluoroethylene having a molecular weight of about 1300 (Teflon Fluoroadditive Type MP 1300, Lot # 68-86, Du Pont) and 500 ml by volume (2.67 kg by weight) molybdenum disulfide (Super Fine Grade, Lot # 510DS, Climax Molybdenum Company).

The mixture of mineral oil, tetrafluoroethylene polymers and molybdenum disulfide was circulated via the circulators mounted in the tank and the mixture in the vat was heated over a period of 2 hours 34 minutes in three increments wherein the vat temperature was first stabilized at 37° C., then at 56° C. and finally the vat temperature was stabilized at 98.5° C.±0.1° C. and was maintained at that temperature resulting in the formation of a heated coating solution. Then, a substrate part which had previously been precleaned in a blast cabinet was submersed in this heated coating solution with agitation (i.e., circulation via the circulators) for a period of 15 minutes.

After completion of this submersion step, the resulting product having a uniform, uninterrupted, thin coating applied to the substrate surface was withdrawn from the vat, and it was found that the resulting product could advantageously be subjected to a post-treatment cleaning and preservation process. In this step of the process, the substrates having the inventive coating applied thereto are cleaned by washing with a cleaning solution such as a soap solution and preserved with an oil that is compatible with the end use of the material, if so desired.

In a further preferred embodiment of the present invention, a coating was produced on the surface of a two inch by two inch square, ¼-inch thick chrome/-molybdenum steel sample. The hardness of the chrome/molybdenum steel sample was 53 as measured on the Rockwell C scale. In the process, the steel sample was subjected to an abrasive cleaning/surface disruption step in a cabinet wherein aluminum oxide shot was impacted onto the steel surface at 60 psi at an angle of about 45° under ambient temperature conditions. Thereafter, the sample was removed from the cabinet by gloved hand and was suspended in a 1000 ml beaker containing a coating solution. This coating solution was prepared by mixing 100 ml. (by volume) tetrafluoroethylene having a molecular weight of about 1500 (Teflon Fluoroadditive Type MP1500J, Lot #999999) in the beaker with 100 ml. (by volume) of molybdenum disulfide (Super Fine Grade, Lot # 510 DS, Climax Molybdenum Co.) and dissolving the solid constituents in 800 ml. (by volume) of veterinary grade mineral oil. The resulting solution contained a ratio by weight of tetrafluoroethylene to molybdenum disulfide of about 1:1.

The suspended sample was maintained immersed in the coating solution for a period of about 15 minutes with constant agitation under heating conditions whereby the solution temperature remained constant throughout this period at 98.5° C.

Subsequent to the dip coating treatment, the surface-coated sample was removed from the beaker and was subjected to a post-treatment cleaning step by subjecting the sample to Stoddard solvent in a Hurri-Kleen Station to remove any residue.

The resulting cleaned, coated surface was subjected to evaluation whereby it was found to have a nonabradable, nonetchable surface which was durable, corrosion resistant and which demonstrated dry lubricity and exceptional wet film entrapment characteristics.

Thus, a method has been described herein for producing a coating on a substrate in a manner such that the resulting product exhibits a wide range of benefits otherwise unavailable. The coated product demonstrates permanent dry lubricity and is highly resistant to temperature extremes. Furthermore, the coated product provides a natural barrier to normal oxidation and corrosion since it is chemically inert. In addition, the coating on the treated substrate surface exhibits exceptional durability and is sufficiently thin for industrial applications, preferably ranging in thickness from about 0.5 microns to about 3.0 microns. Still further, the coatings of the present invention are applied relatively easily and inexpensively in order to provide the desired coatings.

The products produced in accordance with this invention have a multiplicity of uses in a variety of industries and in products containing metal-on-metal friction points or which are subject to metal surface corrosion. Exemplary of the scope of the utilization of the present invention are applications within the automotive industry, fuel handling systems, power tools and equipment, fasteners, ball bearings, rollers and other anti-friction components, consumer products including cookware, houseware and razor blades, turbines, gears and other intermeshing machinery as well as a variety of other potential uses.

Although the invention has been described in its preferred form with a certain degree of particularity, it is to be understood that the present disclosure has been made by way of example only. Numerous changes in the details and operational steps of the methods and in the materials utilized therein will be apparent without departing from the spirit and scope of the invention, as defined in the appended claims.

We claim:

1. A coated product comprising:

a substrate having a uniform coating affixed thereon; said coating consisting essentially of a mixture of a sulfur containing metallic compound, a fluorocarbon polymer and a mineral oil, said coating having a ratio of said fluorocarbon polymer to said sulfur-containing metallic compound in a range of about 1:1 to about 10:1 and providing an impermeable corrosion-resistant, durable, dry lubricant surface on said substrate.

2. The product of claim 1 wherein said substrate is a metal.

3. The product of claim 1 wherein said substrate is selected from the group consisting of ceramic, graphite and rubber compositions.

4. The product of claim 1 wherein said coating is applied to said surface of said substrate by immersing said surface in said coating solution.

5. The product of claim 1 wherein said sulfur-containing metallic compound is molybdenum disulfide.

6. The product of claim 1 wherein said sulfur-containing metallic compound is selected from the group consisting of sulfides of tungsten, lead, tin, copper, calcium, titanium, zinc, chromium, iron, antimony, bismuth, silver, cadmium and alloys and mixtures thereof.

7. The product of claim 1 wherein said fluorocarbon polymer is a mixture of different molecular weight tetrafluoroethylenes including a tetrafluoroethylene having a molecular weight of about 1100 and a tetrafluoroethylene having a molecular weight of about 1300.

8. The product of claim 1 wherein said fluorocarbon polymer is selected from the group consisting of hexafluoropropylene, perfluoroalkoxyvinyl ether, copolymers of tetrafluoroethylene and hexafluoropropylene, copolymers of tetrafluoroethylene and perfluoroalkoxyvinyl ether, ethylenetetrafluoroethylene, polyvinylidene fluoride, ethylchlorotrifluoroethylene, copolymers of ethylene and tetrafluoroethylene and mixture thereof.

9. The product of claim 1 wherein said fluorocarbon polymer is tetrafluoroethylene.

10. The product of claim 9 wherein said tetrafluoroethylene has a molecular weight of about 800–2000.

11. A coated product comprising:

a metal substrate having a uniform coating affixed thereon;

said coating consisting essentially of a mixture of molybdenum disulfide, a fluorocarbon polymer and a mineral oil, said coating having a ratio of said fluorocarbon polymer to said molybdenum disulfide in a range of about 1:1 to about 10:1 and providing an impermeable corrosion-resistant, durable, dry lubricant surface on said substrate.

12. The product of claim 11 wherein said fluorocarbon polymer is a mixture of different molecular weight tetrafluoroethylenes including a tetrafluoroethylene having a molecular weight of about 1100 and a tetrafluoroethylene having a molecular weight of about 1300.

13. The product of claim 11 wherein said fluorocarbon polymer is tetrafluoroethylene.

14. The product of claim 13 wherein said tetrafluoroethylene has a molecular weight of about 800–2000.

* * * * *